US006328357B1

(12) United States Patent
Overbey et al.

(10) Patent No.: US 6,328,357 B1
(45) Date of Patent: Dec. 11, 2001

(54) TRIM ACTUATOR FOR USE WITH AN EXIT DEVICE

(75) Inventors: James Wiley Overbey, Jeffersonville, IN (US); Kun Hong Kim, Louisville, KY (US)

(73) Assignee: Monarch Hardware and Manufacturing Company, Shephardsville, KY (US)

( * ) Notice: Subject to any disclaimer, the term of this patent is extended or adjusted under 35 U.S.C. 154(b) by 0 days.

(21) Appl. No.: 09/419,417

(22) Filed: Oct. 15, 1999

(51) Int. Cl.[7] ..... E05B 3/00; E05C 1/12
(52) U.S. Cl. ..... 292/336.3; 292/172
(58) Field of Search ..... 292/336.3, 244, 292/172, 173, 167, 142, DIG. 53

(56) References Cited

U.S. PATENT DOCUMENTS 4,732,417 * 3/1988 Yang ..... 292/142
4,934,800 * 6/1990 Choi ..... 292/172
5,683,122 * 11/1997 Lee ..... 292/39
5,707,090 * 1/1998 Sedley ..... 292/172
6,058,746 * 5/2000 Mirshafiee et al. ..... 70/107
6,062,612 * 5/2000 Lin ..... 292/144
6,095,573 * 8/2000 Rozema ..... 292/51
6,116,662 * 9/2000 Johnson ..... 292/142
6,209,931 * 4/2001 Von Stoutenborough et al. . 292/160
6,216,500 * 4/2001 Kang ..... 70/224

* cited by examiner

*Primary Examiner*—Anthony Knight
*Assistant Examiner*—Matthew E. Rodgers
(74) *Attorney, Agent, or Firm*—Michael Best & Friedrich LLP

(57) ABSTRACT

An hand adjustable trim actuator for use with an exit device is provided. The trim actuator uses an actuator shaft with attached actuator gear to engage one of two sets of gear teeth on a linearly moveable retractor. Actuation of the door lever rotates a spindle which has two tabs, one of which pushes the retractor. The engagement of the retractor gear teeth with the actuator gear causes the actuator gear and actuator shaft to rotate which in turn operates the exit device. The actuator shaft and actuator gear are moveably linearly which permits the actuator gear to be disengaged from the retractor gear teeth. Once disengaged, the actuator gear can be rotated and moved into engagement with the other of the two sets of gear teeth, thereby changing the handing of the trim actuator.

17 Claims, 4 Drawing Sheets

TRIM ACTUATOR FOR USE WITH AN EXIT DEVICE

BACKGROUND OF THE INVENTION

This invention relates generally to trim actuators for exit devices and more particularly to a trim actuator with means for changing the handing of the exit device trim.

Frequently, exit devices are provided with handle or lever actuated trim on the side of the door opposite the exit device. The lever actuated trim must accommodate the handing of the door. Either the trim must be manufactured in both right hand and left hand configurations, or the trim must be capable of having its handing changed in the field. To change the hanging of some current trims, the installer must disassemble the trim, change the handing and parts and reassemble the trim before continuing the exit device installation. This can become costly due to the increased labor time to change the handing of the trim.

The foregoing illustrates limitations known to exist in present trim actuators. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a trim actuator for use with an exit device, the trim actuator comprising: a linearly moveable retractor, the retractor having two sets of gear teeth thereon; and a linearly and rotatably moveable actuator shaft having an actuator gear at one end thereof, the actuator gear engaging one set of the retractor gear teeth, the actuator shaft and actuator gear being moveable from a first engagement position wherein the actuator gear engages the first set of retractor gear teeth to a second engagement position wherein the actuator gear engages the second set of retractor gear teeth.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

An advantage of the trim actuator shown in the FIGURES is the ability to rapidly and easily change the handing of the trim without disassembling the trim.

Figure 1:
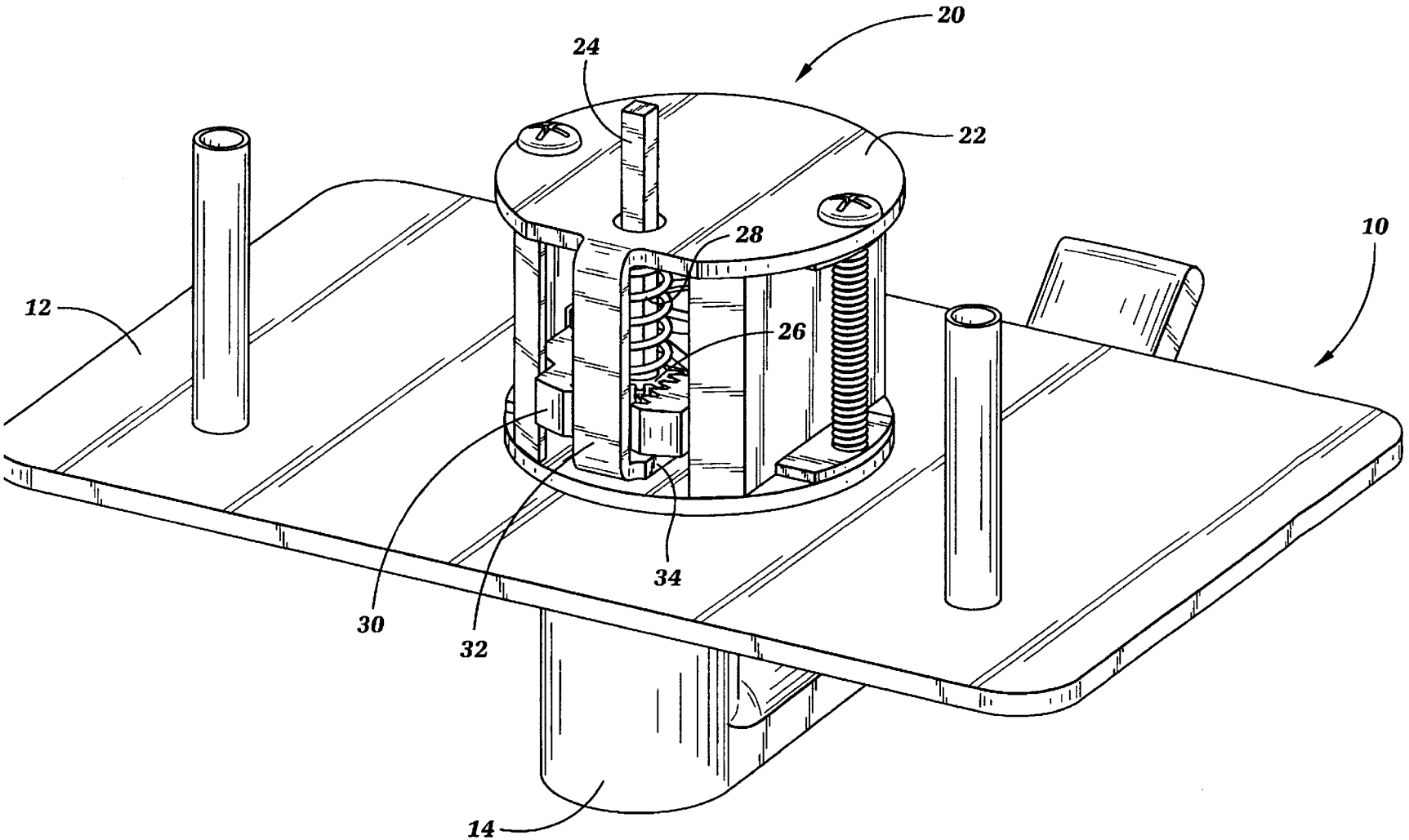
FIG. 1 is a perspective VIEW of a lever trim and trim actuator.

FIG. 1 shows a lever trim 10 with a mounting plate 12 for attachment to a door. A handle or lever 14 is rotatable attached to the mounting plate 12 and has a spindle with retractor tabs 42 attached to the lever 14. Also attached to the mounting plate 12 is trim actuator 20. The trim actuator 20 consists of a linearly slidable retractor 30 which as two sets of gear teeth 31*a* and 31*b* thereon, an actuator shaft 24 with an actuator gear 26 on one end, the actuator gear 26 engaging one set of gear teeth 31*a*, 31*b*, a spring 28 biasing the actuator shaft 24 and actuator gear 26 towards the retractor 30 and housing 22. The housing 22 has a tab 32 extending from a main disk like portion with a leg 34 extending from tab 32. The actuator shaft 24 and actuator gear 26 along with spring 28 are captured between the disk like portion of housing 22 and leg 34.

Figure 3:
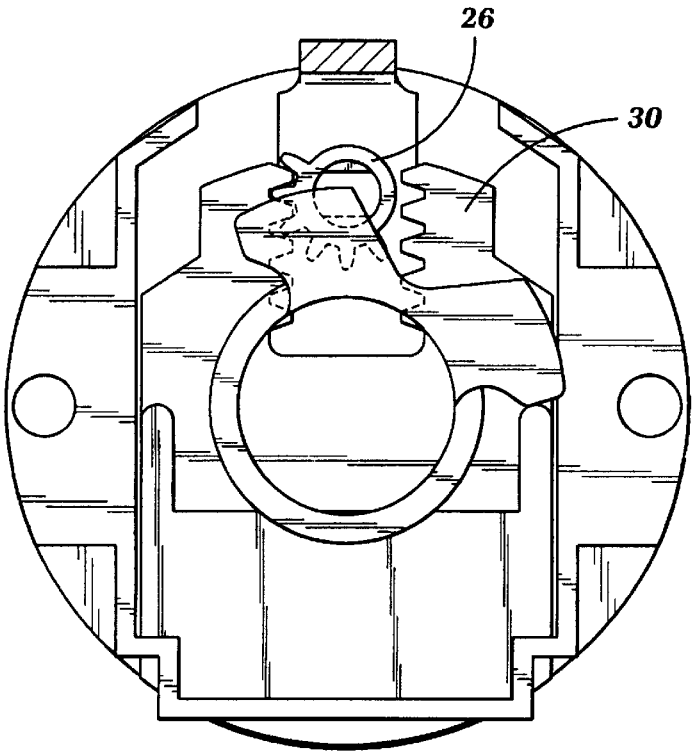
FIG. 3 is an end view of the lever trim shown in FIG. 2 with the retractor shown in an actuated position.

In operation, one of the spindle tabs 42 engages a shoulder 30*a* on retractor 30 and moves retractor 30 linearly as shown in FIG. 3. Gear teeth 31*a* engage actuator gear 26 and rotate actuator gear 26 and attached actuator shaft 24, as shown in FIG. 3. The actuator shaft 24 engages the exit device (not shown) and operates the exit device.

Figure 2:
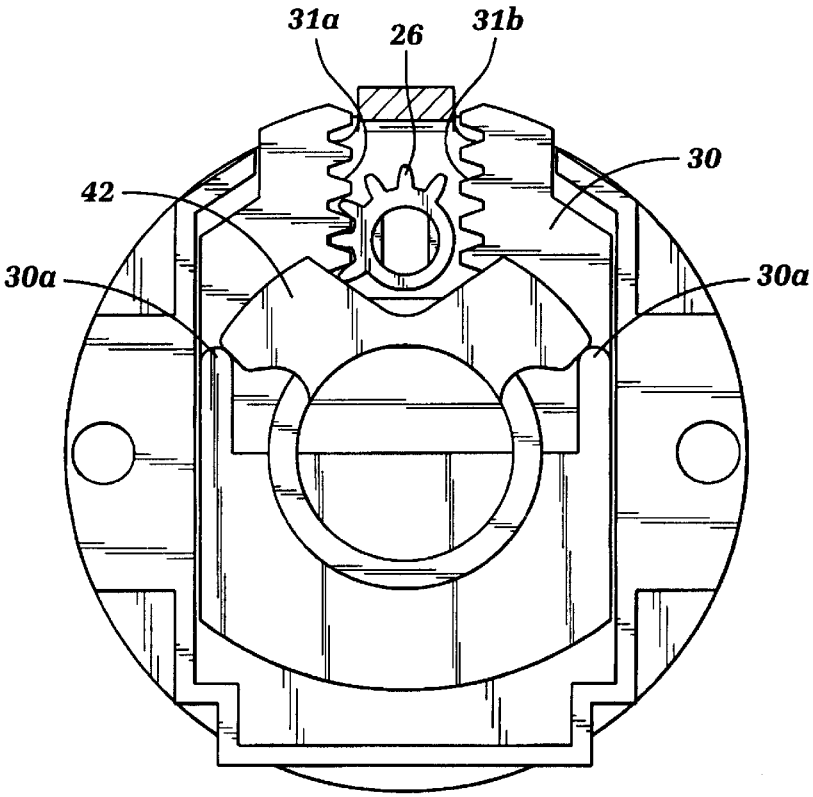
FIG. 2 is an end view of the lever trim shown in FIG. 1 with a portion of the actuator housing removed, the retractor and actuator gear being shown in a first position of engagement.
Figure 2A:
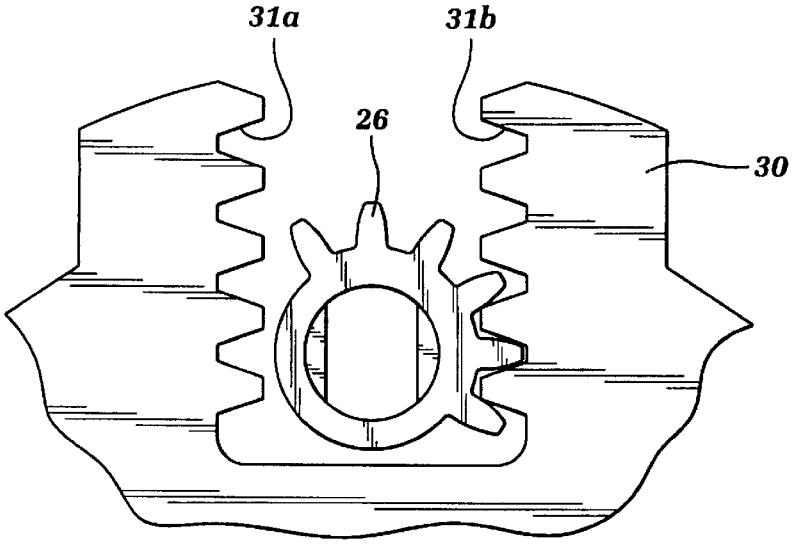
FIG. 2A is a cut-away view of the actuator retractor and actuator gear in the second engagement position.
Figure 4A:
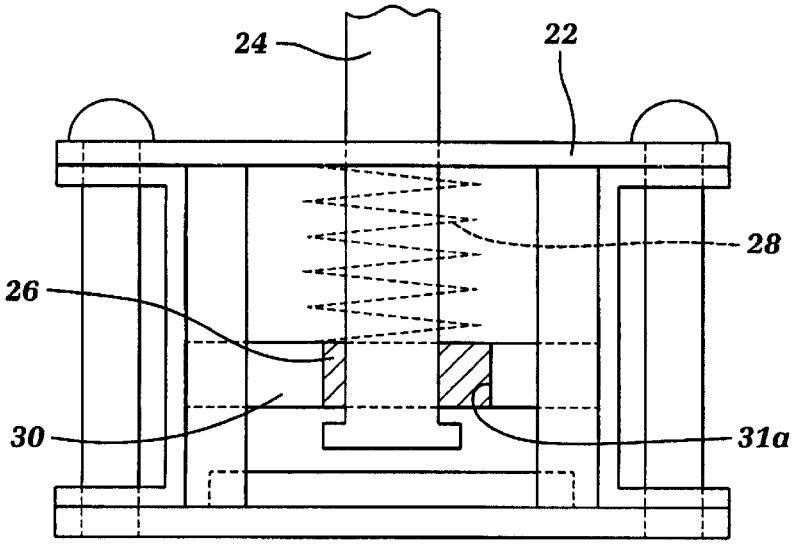
FIGS. 4A, 4B and 4C are schematic views of the lever trim shown in FIG. 1 showing the actuator gear being moved for the first engagement position to the second engagement position.
Figure 4B:
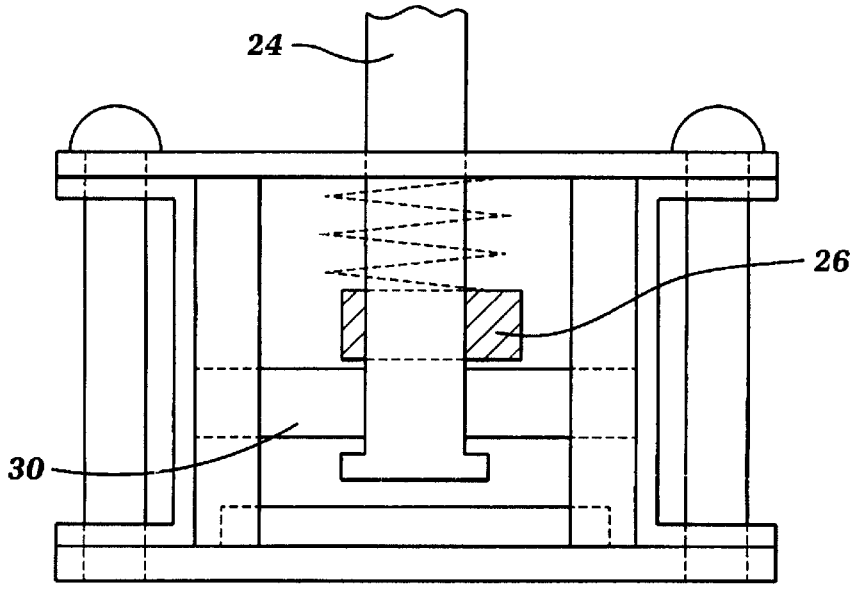
Figure 4C:
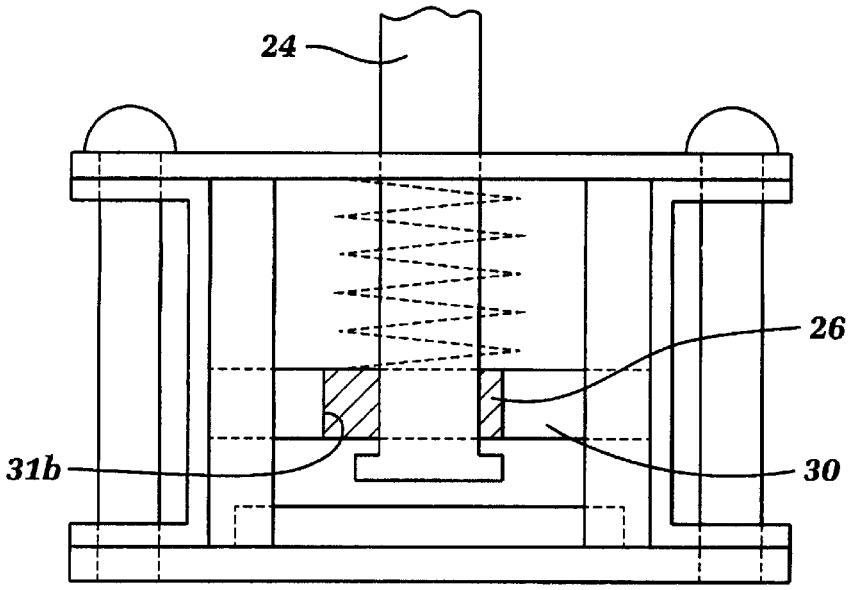

When lever trim 10 is needed for the opposite handing, actuator gear 26 is moved to the other handing position, as shown in FIG. 3. To accomplish this, the actuator shaft 24 and actuator gear 26 are operated as shown in FIGS. 4A, 4B, and 4C. (FIG. 4A shows the trim actuator 20 in the same positioning as in FIG. 2.) First, the actuator shaft 24 and attached actuator gear 26 are lifted linearly as shown in FIG. 4B, which disengages the actuator gear 26 from gear teeth 31*a*. Next, the actuator shaft 24 and actuator gear 26 are rotated to a position corresponding to the positioning shown in FIG. 2A, but with the actuator gear 26 elevated above the retractor 30. Finally, the rotated actuator gear 26 is lowered into engagement with gear teeth 31*b*, as shown in FIG. 4C. The actuator trim 20 is now configured for the opposite handing from the original handing.

Having described the invention, what is claimed is:

1. A handle assembly for use with an exit device, the handle assembly comprising:

a rotatable lever;

a spindle connected to the lever, the spindle having retractor tabs thereon; and a trim actuator comprising: an actuator housing; a linearly moveable retractor operably connected to the retractor tabs, the retractor having two sets of gear teeth thereon; and a linearly and rotatably moveable actuator shaft having an actuator gear at one end thereof, the actuator gear engaging one set of the retractor gear teeth, the actuator shaft and actuator gear being moveable from a first engagement position wherein the actuator gear engages the first set of retractor gear teeth to a second engagement position wherein the actuator gear engages the second set of retractor gear teeth.

2. The handle assembly according to claim 1, wherein the actuator shaft is linearly captured between portions of the actuator housing.

3. The handle assembly according to claim 1, further comprising a spring linearly biasing the actuator shaft towards the retractor.

4. The handle assembly according to claim 1, wherein the actuator shaft direction of linear movement is at a right angle to the retractor direction of linear movement.

5. The handle assembly according to claim 1, wherein the actuator shaft and actuator gear are linearly moveable between a first linear position wherein the actuator gear engages one set of retractor gear teeth to a second linear position wherein the actuator does not engage either set of retractor gear teeth.

6. The handle assembly according to claim 5, wherein the actuator shaft and actuator gear are rotatable between a first rotary position corresponding to the first engagement position and a second rotary position corresponding to the second engagement position when the actuator shaft and actuator gear are in the second linear position.

7. The handle assembly according to claim 1, wherein the actuator housing comprises a disk portion having a tab extending at a right angle therefrom and a leg extending at a right angle from the tab, an end of the actuator shaft being biased into contact with the leg.

8. A handle assembly for use with an exit device, the handle assembly comprising:

a rotatable lever;

a spindle connected to the lever, the spindle having retractor tabs thereon; and a trim actuator comprising: an actuator housing; a linearly moveable retractor operably connected to the retractor tabs, the retractor having two sets of gear teeth thereon; and a linearly and rotatably moveable actuator shaft having an actuator gear at one end thereof, the actuator gear engaging one set of the retractor gear teeth, the actuator shaft and actuator gear being moveable from a first engagement position wherein the actuator gear engages the first set of retractor gear teeth to a second engagement position wherein the actuator gear engages the second set of retractor gear teeth, the actuator shaft and actuator gear being linearly moveable between a first linear position wherein the actuator gear engages one set of retractor gear teeth to a second linear position wherein the actuator does not engage either set of retractor gear teeth, the actuator shaft and actuator gear being rotatable between a first rotary position corresponding to the first engagement position and a second rotary position corresponding to the second engagement position when the actuator shaft and actuator gear are in the second linear position.

9. The handle assembly according to claim 8, wherein the actuator shaft is linearly captured between portions of the actuator housing.

10. A handle assembly for use with an exit device, the handle assembly comprising:

a rotatable lever;

a spindle connected to the lever, the spindle having retractor tabs thereon; and a trim actuator comprising: an actuator housing; a linearly moveable retractor operably connected to the retractor tabs, the retractor having two sets of gear teeth thereon; and a linearly and rotatably moveable actuator shaft having an actuator gear at one end thereof, the actuator gear engaging one set of the retractor gear teeth, the actuator shaft and actuator gear being rotatable from a first engagement position wherein the actuator gear engages the first set of retractor gear teeth to a second engagement position wherein the actuator gear engages the second set of retractor gear teeth, the actuator shaft direction of linear movement being at a right angle to the retractor direction of linear movement.

11. A trim actuator for use with an exit device, the trim actuator comprising:

a linearly moveable retractor, the retractor having two sets of gear teeth thereon; and a linearly and rotatably moveable actuator shaft having an actuator gear at one end thereof, the actuator gear engaging one set of the retractor gear teeth, the actuator shaft and actuator gear being moveable from a first engagement position wherein the actuator gear engages the first set of retractor gear teeth to a second engagement position wherein the actuator gear engages the second set of retractor gear teeth.

12. The trim actuator according to claim 11, further comprising a spring linearly biasing the actuator shaft towards the retractor.

13. The trim actuator according to claim 11, wherein the actuator shaft direction of linear movement is at a right angle to the retractor direction of linear movement.

14. The trim actuator according to claim 11, wherein the actuator shaft and actuator gear are linearly moveable between a first linear position wherein the actuator gear engages one set of retractor gear teeth to a second linear position wherein the actuator does not engage either set of retractor gear teeth.

15. The trim actuator according to claim 14, wherein the actuator shaft and actuator gear are rotatable between a first rotary position corresponding to the first engagement position and a second rotary position corresponding to the second engagement position when the actuator shaft and actuator gear are in the second linear position.

16. The trim actuator according to claim 11, further comprising:

an actuator housing, the actuator shaft being linearly captured between portions of the actuator housing.

17. The trim actuator according to claim 16, wherein the actuator housing comprises a disk portion having a tab extending at a right angle therefrom and a leg extending at a right angle from the tab, an end of the actuator shaft being biased into contact with the leg.

* * * * *